US009713349B2

(12) United States Patent
Campbell

(10) Patent No.: US 9,713,349 B2
(45) Date of Patent: Jul. 25, 2017

(54) TWO SOCK SYSTEM

(71) Applicant: Eldad Kenzo Campbell, Glenwood Landing, NY (US)

(72) Inventor: Eldad Kenzo Campbell, Glenwood Landing, NY (US)

( * ) Notice: Subject to any disclaimer, the term of this patent is extended or adjusted under 35 U.S.C. 154(b) by 0 days.

(21) Appl. No.: 14/685,691

(22) Filed: Apr. 14, 2015

(65) Prior Publication Data

US 2016/0302491 A1 Oct. 20, 2016

(51) Int. Cl.

*A41B 11/00* (2006.01)
*A41B 11/12* (2006.01)
*A41B 11/02* (2006.01)

(52) U.S. Cl.

CPC ..... *A41B 11/003* (2013.01); *A41B 11/005* (2013.01); *A41B 11/008* (2013.01); *A41B 11/12* (2013.01); *A41B 11/02* (2013.01); *A41B 2400/20* (2013.01); *A41B 2400/22* (2013.01); *A41B 2400/82* (2013.01)

(58) Field of Classification Search

CPC ..... A41B 11/00; A41B 11/12; A41B 11/02
USPC ..... 2/239, 240, 241, 242
See application file for complete search history.

(56) References Cited

U.S. PATENT DOCUMENTS 2,153,493 A * 4/1939 Yakimchick ..... A41B 11/10 2/240
3,259,915 A * 7/1966 Dison ..... A41B 11/005 2/239
4,373,215 A * 2/1983 Guigley ..... A41B 11/005 2/239
4,843,844 A * 7/1989 Hursh ..... A41B 11/005 66/196
5,226,194 A * 7/1993 Staley ..... A41B 11/005 2/239
5,615,418 A * 4/1997 Pruit ..... A41B 11/005 2/239
5,778,702 A * 7/1998 Wrightenberry ..... A41B 11/005 2/239

* cited by examiner

*Primary Examiner* — Tejash Patel
(74) *Attorney, Agent, or Firm* — Kohn & Associates, PLLC

(57) ABSTRACT

A two sock system, including an inner sock, and an outer sock surrounding the inner sock, wherein the inner sock and the outer sock include a support band system that prevents movement of the inner sock relative to the outer sock. A method of preventing movement between an inner sock and outer sock in a two sock system, by preventing movement of the inner sock on a user's foot, and preventing movement of the outer sock on the inner sock, wherein the inner sock and outer sock are unattached.

20 Claims, 6 Drawing Sheets

TWO SOCK SYSTEM

BACKGROUND OF THE INVENTION

1. Technical Field

The present invention relates to socks. More specifically, the present invention relates to athletic socks that provide cushioning and support.

2. Background Art

Many athletes require support for their feet and special socks when moving around to stay comfortable in their shoes. Quick movement from side to side requires additional padding in certain areas as opposed to others to prevent the shoe from rubbing on the foot and causing blisters. Many athletes resort to wearing two pairs of socks in order to achieve the comfort and protection that they require.

U.S. Pat. No. 5,226,194 to Staley discloses a double-layered sock 10 including an inner sock 11 having water vapor transfer properties and an outer sock 12 that is water absorbent to keep perspiration away from the skin. Outer sock 12 has a small vent panel 16 located near its toe end on the top of the sock. The inner sock 11 is preferably concealed by the outer sock 12. Inner and outer socks 11, 12 are secured together by any suitable means, such as sewing, Velcro or snap fasteners, or the like.

WO 03/013290 to Lambertz discloses a sock for sporting activities including an outer sock (A) and an inner sock (B), which are connected to each other by sewing. The sock can include an X-cross bandage (41) (i.e. a band) that supports the ankle. The sock reduces friction between the foot and sock.

Prior art socks that are designed to be used as part of a two sock system are attached at some part of the sock and are not separate. They cannot function without being attached because they would slip with respect to the foot of the user.

Therefore, there remains a need for an athletic sock that uses two socks that are not attached that can provide comfort and remain in place during use.

SUMMARY OF THE INVENTION

The present invention provides for a two sock system, including an inner sock, and an outer sock surrounding the inner sock, wherein the inner sock and the outer sock include a support band system that prevents movement of the inner sock relative to the outer sock.

The present invention further provides for a method of preventing movement between an inner sock and outer sock in a two sock system, by preventing movement of the inner sock on a user's foot, and preventing movement of the outer sock on the inner sock, wherein the inner sock and outer sock are unattached.

DESCRIPTION OF THE DRAWINGS

Other advantages of the present invention are readily appreciated as the same becomes better understood by reference to the following detailed description when considered in connection with the accompanying drawings wherein.

DETAILED DESCRIPTION OF THE INVENTION

Figure 1B:
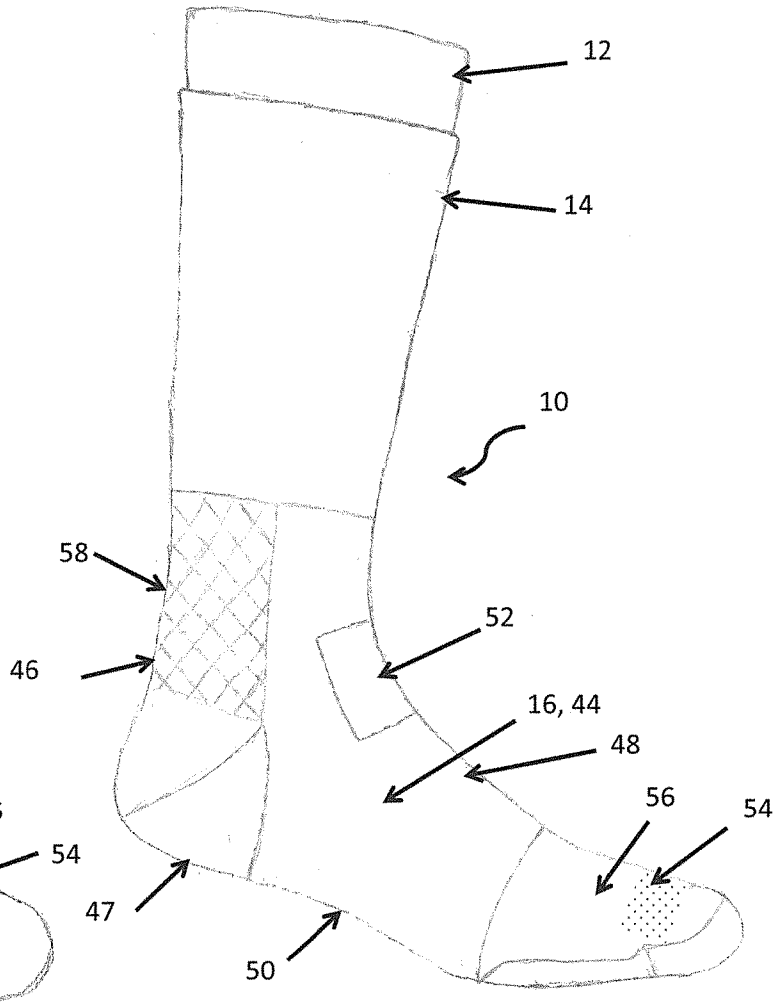
FIG. 1B is a side view of the two sock system.
Figure 1A:
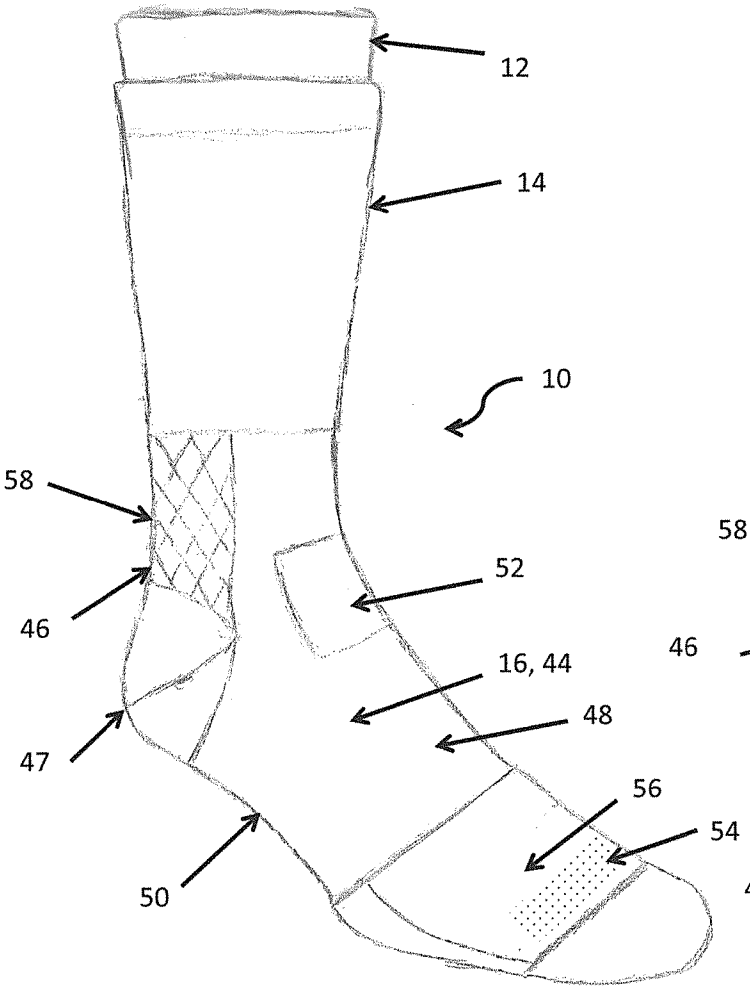
FIG. 1A is a front perspective view of the two sock system.
Figure 1C:
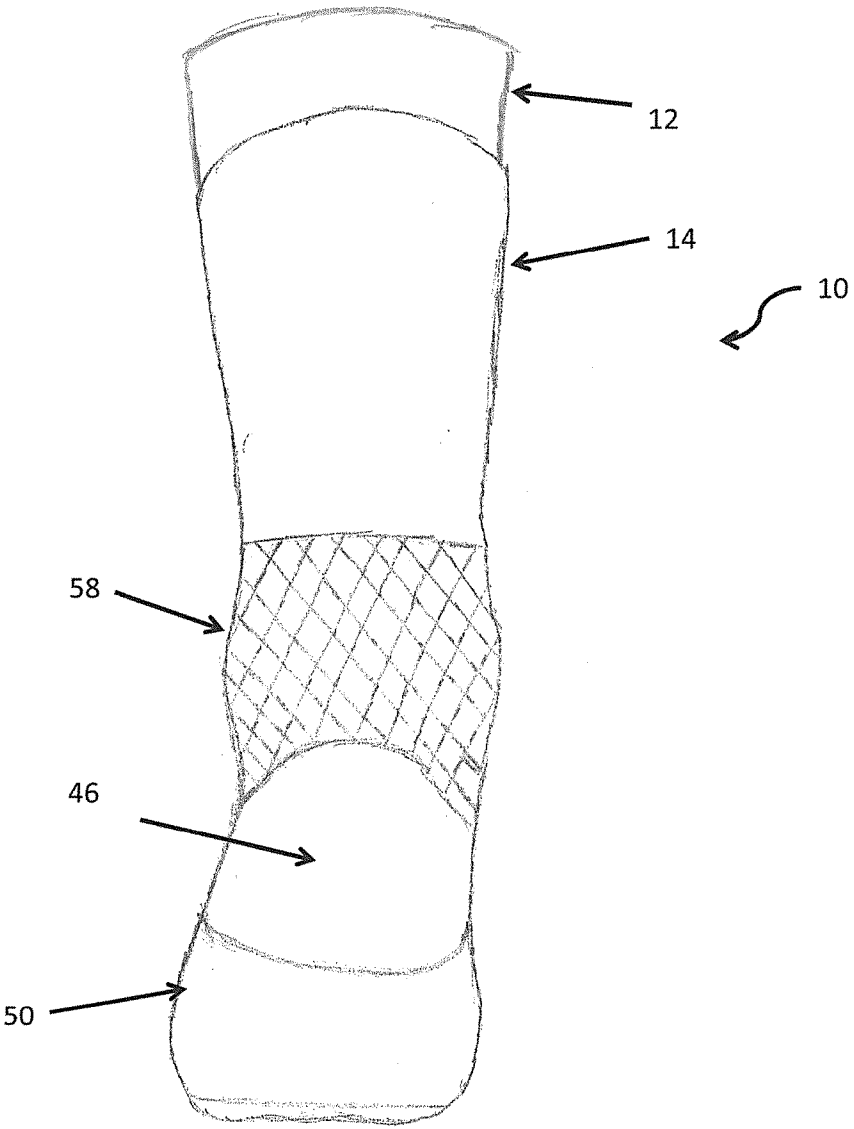
FIG. 1C is a back view of the two sock system.

The present invention generally provides for a two sock system, indicated at 10 in FIGS. 1A-1C, including an inner sock 12, and an outer sock 14 surrounding the inner sock 12, wherein the inner sock 12 and the outer sock 14 include a support band system 16 that prevents movement of the inner sock 12 relative to the outer sock 14. The two sock system 10 provides comfort and support to the foot, especially during rigorous athletic use. The inner sock 12 is generally looser fitting than the outer sock 14 in order to provide a custom fit of the two sock system 10.

The inner sock 12, shown in FIGS. 2A-2D, provides comfort and breathability to the foot in the two sock system 10. The inner sock 12 includes an ankle support band 18 and an arch support band 20 on either side of (i.e. surrounding) a loose portion 22. The ankle support band 18 and the arch support band 20 fit tightly on the foot in order to secure the inner sock 12 to the foot, whereas the loose portion 22 provides comfort and does not contain as much elastic as the ankle support band 18 and the arch support band 20.

Preferably, the ankle support band 18 is located above or at an ankle portion 30 of the inner sock 12. Preferably, the arch support band 20 is located at an arch portion 32 of the inner sock 12. The ankle support band 18 and the arch support band 20 can be different sizes or the same size, or have different tightness depending on the size of portions of the foot. The loose portion 22 can include a heel portion 42 and an instep area 38. It should be understood that the ankle support band 18 and the arch support band 20 can be different sizes and can be located at various lengths of the inner sock 12, as long as they are separated by the loose portion 22, secure the inner sock 12 to the foot, and are at appropriate lengths to function in the support band system 16, described in detail below. On the opposite side of the ankle support band 18 from the loose portion 22 is an upper portion 62 that is not as loose as the loose portion 22 but not as tight as the ankle support band 18. The upper portion 62 can include an upper band 60 for design purposes of any size.

Various additional padded areas can be included at any desired place and in any desired size on the inner sock 12, such as, but not limited to a heel pad 24, a toe pad 26, an instep pad 28, and combinations thereof. Each of these padded areas can be located at any place where it is desired to provide additional cushioning or protection of the foot from rubbing with shoes, and can be tailored to movement in a particular sport. For example, the heel pad 24 can extend on the heel portion 42 from the ankle support band 18 to the arch support band 20. The toe pad 26 can be located on a top side 34 of a toe portion 36. The toe pad 26 can be especially beneficial to tennis players as they tend to wear out this area of sock first. The instep pad 28 can be located at an instep portion 38, and can provide comfort and reduce irritation of the instep while moving. In general, the two sock system 10 provides more cushioning to the sole of the foot than other socks.

Figures 2A, 2B:
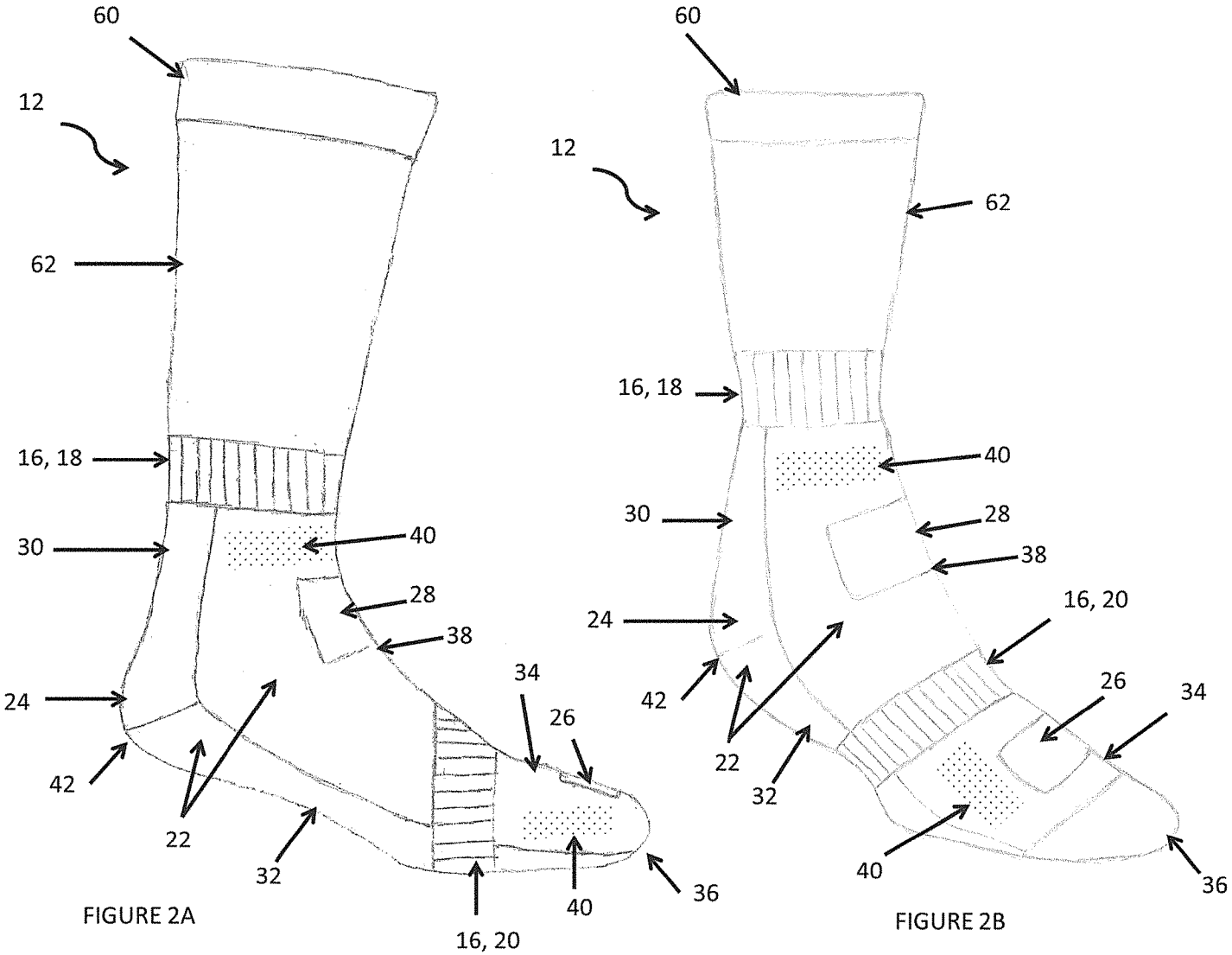
FIG. 2A is a side view of an inner sock.
FIG. 2B is a front perspective view of the inner sock.
Figure 2D:
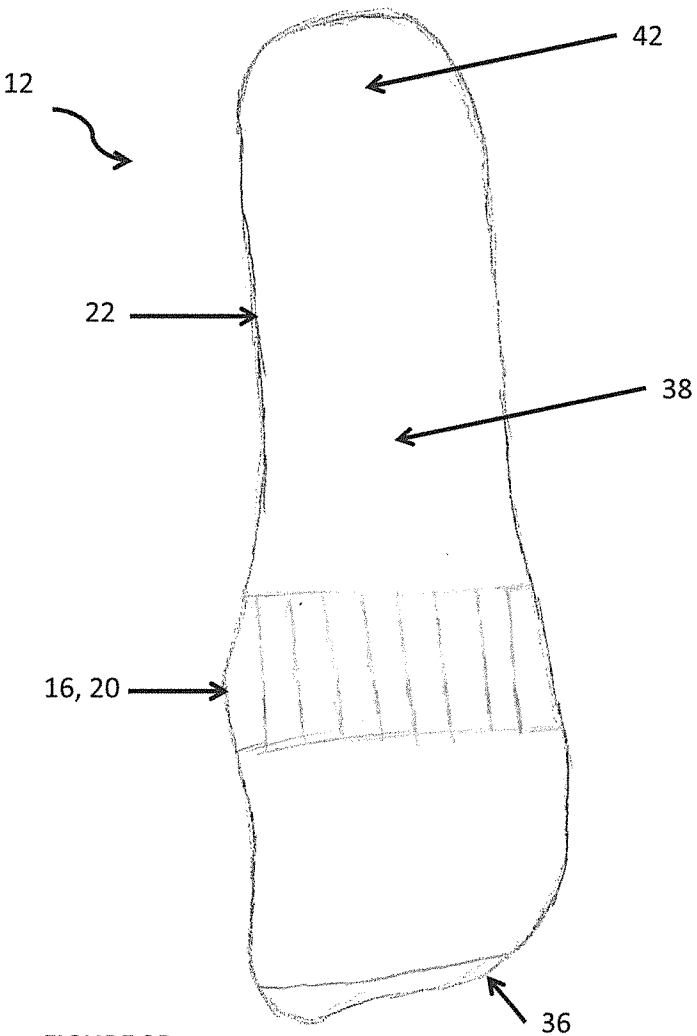
FIG. 2D is a bottom view of the inner sock.
Figure 2C:
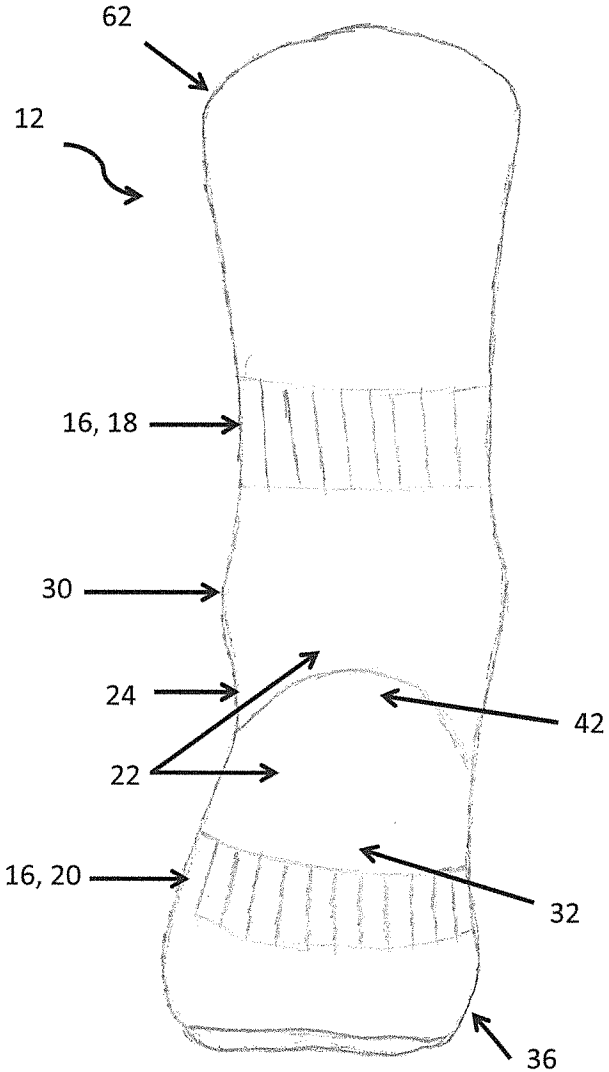
FIG. 2C is a back view of the inner sock.
Figures 3A, 3B:
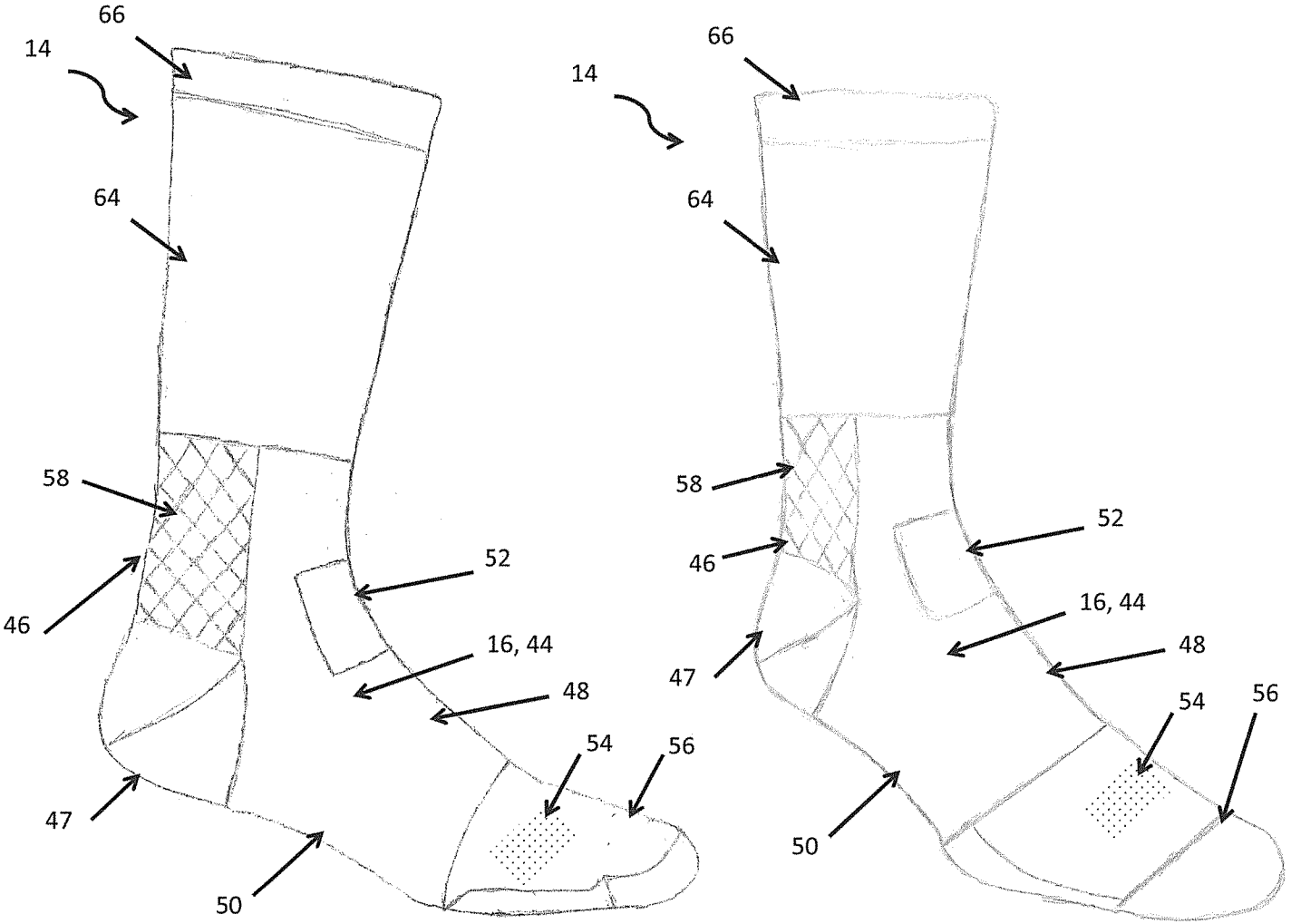
FIG. 3A is a side view of an outer sock.
FIG. 3B is a front perspective view of the outer sock.
Figure 3D:
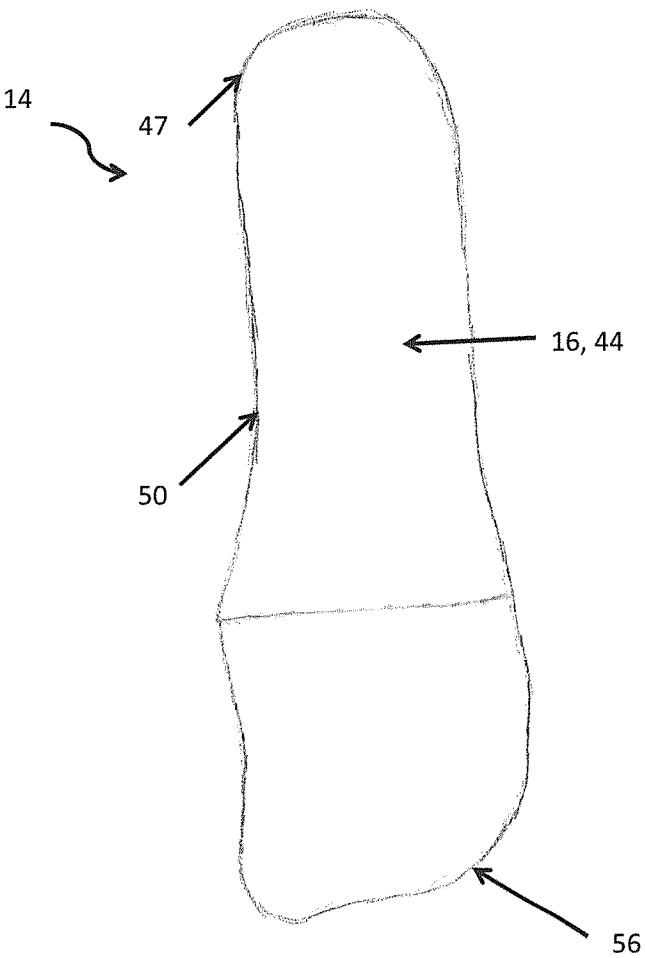
FIG. 3D is a bottom view of the outer sock.
Figure 3C:
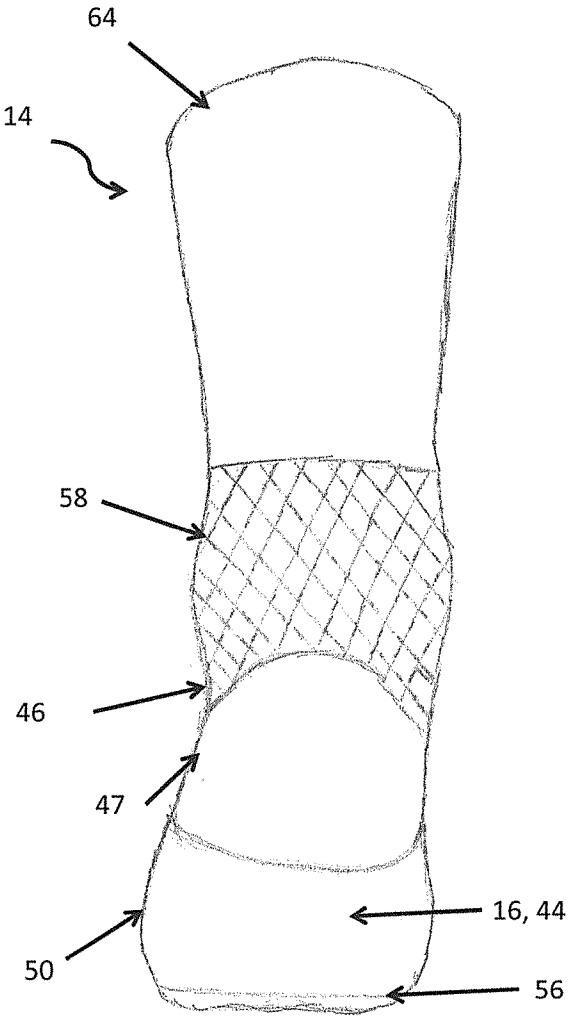
FIG. 3C is a back view of the outer sock.

Mesh vents 40 can be incorporated in any of the portions of the inner sock 12 as desired for ventilation purposes, with several shown in FIGS. 2A and 2B. It should be understood that the mesh vents 40 can be incorporated in only part of a portion or in the whole portion of the various areas of the inner sock 12. In a particular example, mesh vents 40 can be incorporated in the ankle support band 18, the loose portion 22, the arch support band 20, parts of the toe portion 36, and the instep pad 28.

Preferably, the inner sock 12 is slightly longer above the ankle portion 30 than the outer sock 14 such that the upper portion 62 is seen above an upper portion 66 of the outer sock 14, i.e. the outer sock 14 is shorter than the inner sock 12. However, the inner sock 12 can be any other desired length depending on the style or look desired, such as the same length as the outer sock 14 or shorter than the outer sock 14.

The outer sock 14, shown in FIGS. 3A-3D, provides support in the two sock system 10. The outer sock 14 includes an outer support band 44 that preferably extends over an ankle portion 46, an instep portion 48, and an arch portion 50 of the outer sock 14. The outer support band 44 preferably does not include a heel portion 47; however, the heel portion 47 is preferably tighter than the heel portion 42 of the inner sock 12 to still provide support. The outer support band 44 can cover any suitable part of portions 46, 48, 50. However, the outer support band 44 is preferably sized to correspond to the entire loose portion 22 of the inner sock 12. The outer support band 44 is tight and includes more elastic than the rest of the outer sock 14 (i.e. adjacent toe portion 56, ankle portion 46, and upper portion 64) in order to provide support to the foot. On the opposite side of the outer support band 44 from the toe portion 56 is an upper portion 64 that is not as tight as the outer support band 44. The upper portion 64 can include an upper band 66 for design purposes of any size.

The outer sock 14 can include various padding, such as instep pad 52 located at instep portion 48, for any area of the foot where further comfort is desired. However, it is also desired that the outer sock 14 not be especially bulky so that it is tight fitting and therefore padding can be omitted.

Mesh vents 54 can be incorporated in any of the portions of the outer sock 14 as desired for ventilation purposes. It should be understood that the mesh vents 54 can be incorporated in only part of a portion or in the whole portion of the various areas of the outer sock 14. In a particular example, mesh vents 54 are incorporated in parts of a toe portion 56.

Various portions of the inner sock 12 and outer sock 14 can include design features 58 for style purposes. For example, outer sock 14 can include a diamond design feature 58 in the ankle portion 46. The design features 58 can provide additional support (and include more elastic than other areas) or merely be ornamental.

The support band system 16 prevents movement of the inner sock 12 relative to the outer sock 14 without the need for the inner sock 12 and outer sock 14 to be attached, unlike in previous sock systems. In other words, inner sock 12 and outer sock 14 are not physically attached in any manner, they are unattached. The ankle support band 18 and the arch support band 20 grip the inner sock 12 to the user's foot to prevent movement of the inner sock. The outer support band 44 of the outer sock 14 grips the loose portion 22 of the inner sock 12 and prevents the outer sock 14 from moving with respect to the inner sock 12. Prior art sock designs are traditionally looser in the areas of the support band system 16 compared to the two sock system 10.

The two sock system 10 can be made of any suitable material, such as, but not limited to cotton, nylon, wool, acrylic, fleece, moisture-managing fabrics (e.g. COOLMAX® (Invista Apparel)), spandex, skin-temperature regulating fabrics (e.g. JOCKEY® Staycool), linen, silk, and combinations thereof. Different portions of the two sock system 10, the inner sock 12, and/or the outer sock 14 can be made with different fabrics as desired. It is desired that the materials used for the inner sock 12 and the outer sock 14 not be too thick (except in areas where thicker portions are desired (i.e. the pads) so they can be worn comfortably together in a shoe in the two sock system 10.

The two sock system 10 can be made in any colors and designs desired. For example, the inner sock 12 can be a first color, and the outer sock 14 can be a second color. Team logos and colors can be incorporated in the design as desired.

The two sock system 10 is especially useful while playing sports or moving on one's feet in a rigorous manner. For example, the two sock system 10 is useful for playing tennis, football, baseball, basketball, rugby, soccer, running, hockey, or any other sport.

When the inner sock 12 and outer sock 14 are worn together, the two sock system 10 delays sweat running down the wearer's leg into their shoe and reduces friction between the foot and the shoe. The two sock system 10 further provides support, comfort, and breathability to the wearer.

The present invention further provides a method of preventing movement between an inner sock 12 and outer sock 14 in a two sock system 10, by preventing movement of the inner sock 12 on a user's foot, and preventing movement of the outer sock 14 on the inner sock 12, wherein the inner sock 12 and outer sock 14 are unattached to each other physically. Movement of the inner sock 12 is prevented by gripping the inner sock 12 to the user's foot, and movement of the outer sock 14 is prevented by gripping the outer sock 14 to the inner sock 12. More specifically, ankle support band 18 and arch support band 20 grip the inner sock 12 to the user's foot to prevent movement of the inner sock 12. The outer support band 44 of the outer sock 14 grips the loose portion 22 of the inner sock 12 and prevents the outer sock 14 from moving with respect to the inner sock 12. Each of these elements have been described above.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A two sock system, comprising:

an inner sock including an ankle support band and arch support band surrounding a loose portion that contains less elastic than said ankle support band and said arch support band; and an outer sock surrounding said inner sock, wherein said inner sock and said outer sock include support band means for preventing movement of said inner sock relative to said outer sock.

2. The two sock system of claim 1, wherein said an ankle support band and arch support band grip a user's foot tightly.

3. The two sock system of claim 1, wherein said loose portion includes a heel portion and instep area.

4. The two sock system of claim 1, wherein said inner sock includes at least one padded area chosen from the group consisting of a heel pad, a toe pad, an instep pad, and combinations thereof.

5. The two sock system of claim 1, wherein said inner sock further includes mesh vents.

6. The two sock system of claim 5, wherein said mesh vents are incorporated in said ankle support band, said loose portion, said arch support band, a toe portion, and an instep pad.

7. The two sock system of claim 1, wherein an upper portion of said inner sock is chosen from the group consisting of longer than, the same length as, and shorter than said outer sock.

8. The two sock system of claim 1, wherein said inner sock provides comfort to a user's foot.

9. The two sock system of claim 1, wherein said outer sock includes an outer support band extending over an ankle portion, an instep portion, and an arch portion.

10. The two sock system of claim 9, wherein said outer support band corresponds in size to said loose portion.

11. The two sock system of claim 9, wherein said outer support band contains more elastic than an adjacent toe portion, heel portion, and upper portion.

12. The two sock system of claim 1, wherein said outer sock provides support to a user's foot.

13. The two sock system of claim 1, wherein said outer sock includes at least one padded area.

14. The two sock system of claim 1, wherein said outer sock further includes mesh vents.

15. The two sock system of claim 9, wherein said support band means is further defined as said ankle support band and said arch support band gripping said inner sock to a user's foot and said outer support band of said outer sock gripping said loose portion.

16. The two sock system of claim 1, wherein said inner sock and said outer sock are made from a material chosen from the group consisting of cotton, nylon, wool, acrylic, fleece, moisture-managing fabrics, spandex, skin-temperature regulating fabrics, linen, silk, and combinations thereof.

17. The two sock system of claim 1, wherein said inner sock and outer sock are unattached.

18. A method of preventing movement between an inner sock and outer sock in a two sock system, including the steps of:

preventing movement of the inner sock on a user's foot; and preventing movement of the outer sock on the inner sock, wherein the inner sock and outer sock are unattached, and wherein the inner sock includes an ankle support band and arch support band surrounding a loose portion that contains less elastic than the ankle support band and the arch support band, wherein the outer sock surrounds the inner sock, and wherein the inner sock and the outer sock include support band means for preventing movement of the inner sock relative to the outer sock.

19. The method of claim 18, wherein said preventing movement of the inner sock is further defined as gripping the inner sock to the user's foot, and said preventing movement of the outer sock is further defined as gripping the outer sock to the inner sock.

20. The method of claim 19, wherein said gripping the inner sock step is further defined as the n ankle support band and the arch support band gripping the inner sock to the user's foot, and wherein said gripping the outer sock step is further defined as an outer support band of the outer sock gripping the loose portion surrounded by the ankle support band and arch support band of the inner sock.

* * * * *